US005113039A

United States Patent [19]

Guipe et al.

[11] Patent Number: 5,113,039

[45] Date of Patent: May 12, 1992

[54] FLEXIBLE CORD WITH HIGH MODULUS ORGANIC FIBER STRENGTH MEMBER

[75] Inventors: Richard A. Guipe; Shakil U. Qureshi; Larry W. Oden, all of Richmond, Ind.

[73] Assignee: Cooper Industries, Inc., Houston, Tex.

[21] Appl. No.: 639,041

[22] Filed: Jan. 9, 1991

Related U.S. Application Data

[63] Continuation-in-part of Ser. No. 347,416, May 4, 1989, abandoned.

[51] Int. Cl.[5] ..... H01B 7/02; H01B 13/14

[52] U.S. Cl. ..... 174/113 C; 156/50; 156/51; 156/247; 174/74 R; 174/110 F; 174/131 A

[58] Field of Search ..... 174/113 C, 131 A, 131 R, 174/74 R, 110 F, 110 V; 156/50, 51, 247, 344; 30/90.1

[56] References Cited

U.S. PATENT DOCUMENTS

| | | | |
|---|---|---|---|
| 1,977,209 | 10/1934 | Sargent | 264/103 |
| 2,325,549 | 7/1943 | Ryzowitz | 174/120 R |
| 2,386,753 | 10/1945 | Shield | 174/36 |
| 3,082,523 | 3/1963 | Modes et al. | 156/247 X |
| 3,180,184 | 4/1965 | Bradley | 30/90.1 |
| 3,589,121 | 6/1971 | Mulvey | 156/51 X |
| 3,681,510 | 8/1972 | Lemieux | 174/110 F X |
| 3,703,840 | 11/1972 | Kauf | 30/90.1 |
| 3,710,006 | 1/1973 | Davis | 174/113 C X |
| 3,717,720 | 2/1973 | Snellman | 174/131 A |
| 3,740,454 | 6/1973 | Arndt et al. | 174/110 F X |
| 3,985,951 | 10/1976 | Harris | 174/110 F X |
| 4,084,065 | 4/1978 | Swenson | 174/131 A X |
| 4,090,763 | 5/1978 | Congdon et al. | 174/113 C X |
| 4,097,686 | 6/1978 | Gladenbeck et al. | 174/131 A |
| 4,345,362 | 8/1982 | de Givry | 29/867 X |
| 4,443,658 | 4/1984 | Seguin | 174/113 C |
| 4,449,012 | 5/1984 | Voser | 174/113 C X |
| 4,707,569 | 11/1987 | Yoshimura et al. | 174/110 F X |
| 4,816,611 | 3/1989 | Invernizzi | 174/131 A X |
| 4,820,012 | 4/1989 | Asai | 174/131 A X |
| 4,958,433 | 9/1990 | Persson | 30/90.1 X |

FOREIGN PATENT DOCUMENTS

| | | |
|---|---|---|
| 1024228 | 7/1975 | Canada . |
| 1203159 | 1/1960 | France . |
| 2023328 | 12/1979 | United Kingdom . |

OTHER PUBLICATIONS

Totsuka, M. et al.,; The Small Size Telephone Set Cord; Review of the Electrical Communication Laboratories; vol. 22, Nos. 3-4; Mar.-Apr. 1974.

*Primary Examiner*—Morris H. Nimmo
*Attorney, Agent, or Firm*—Fitch, Even, Tabin & Flannery

[57] ABSTRACT

An electrical cable has a single yarn polyamide fiber strength member with a plurality of copper strands positioned adjacent thereto. An insulator jacket is extruded over the copper strands and the strength member to provide a insulated lead of high strength. A foam filler layer is extruded over a plurality of such leads, and a non-porous jacket is extruded over the foam filler layer, providing a light weight, flexible, high-strength, multi-lead cable, which is easily stripped by automated equipment.

16 Claims, 5 Drawing Sheets

FLEXIBLE CORD WITH HIGH MODULUS ORGANIC FIBER STRENGTH MEMBER

CROSS REFERENCE TO RELATED APPLICATION

This is a continuation-in-part of pending U.S. application Ser. No. 347,416, filed May 4, 1989, now abandoned by Larry Wayne Oden, et al.

BACKGROUND OF THE INVENTION

The invention relates in general to a reinforced electrically conductive cable and in particular to an electrical cable having a single yarn high modulus organic fiber strength member surrounded by metal conductors.

Conventional electrical cables of the type used in household electric cord sets are manufactured from stranded copper wire surrounded by a filler material, such as paper, jute, cotton or rayon. The filler material reduces the amount of jacket material required for the cord and is typically helically wrapped about the stranded copper conductors. An insulator, such as a polyvinylchloride jacket, is extruded over the filler material to complete the cord.

Unfortunately those household cord sets suffer from several drawbacks. At present, there is a requirement that household electric cord sets have sufficient tensile strength to withstand a tensile force of 170 pounds. The primary strength providing members in prior art cord sets are the conductors and the filler material within the cord set, which may fail under the stress of such a force.

In addition, it has become relatively expensive to manufacture cord sets using paper and jute fillers. The paper and jute fillers are meant to occupy volume, as well as provide tensile strength within the cable, so that for a given outside diameter of a cable jacket less polyvinylchloride insulation is required, thereby saving money. It is often necessary for an electric plug or connector to be attached to the cord. As a result, the outer layer of polyvinylchloride insulation must be removed completely without nicking or damaging the copper wire conductor strands and causing a loss of conductivity which may result in an increase in the resistivity of the wire. Such an unwanted increase in resistivity may cause the wire to overheat when it is connected to a low impedance electrical load. As a result, it is necessary to remove the insulating polyvinylchloride layer manually, after which the jute or paper filling is removed manually. Attempts to automate the labor-intensive insulation stripping process have met with little success because complete removal of the insulation and filler often results in damage to the underlying conductors.

Cords with multiple insulated leads conventionally have an outer jacket of polyvinylchloride, which holds the leads together and provides additional protection against damage. To achieve a given overall cord thickness and fill the grooves between leads, paper or jute fillers are bundled with the inner leads and a polyvinylchloride jacket is extruded around the bundle, thereby reducing the amount of polyvinylchloride used. These fillers result in the same obstacles to automated stripping as mentioned above.

In addition, such fillers do not have the flexibility that polyvinylchloride has, and so add to the stiffness of the cord. To retain maximum flexibility, the grooves between leads would have to be filled with polyvinylchloride, which would make the cable unnecessarily heavy.

Co-axial cords are known which contain organic foam. However, because the purpose of the foam is to improve electrical transmission through the dielectric properties of the foam, the foam is extruded in contact with the conductive metal of the cord. The foam is not used as a filler material between two non-porous, insulating jackets, as paper or jute are used as mentioned above.

What is needed, then, is an improved electrical cable or cord strong enough to withstand a tensile force of 170 pounds or more, requiring a minimum of polyvinylchloride, retaining maximal flexibility and minimal weight, and which may be stripped of insulation quickly and easily in order to expose the copper conductors for connection to plug assemblies, connectors and the like.

SUMMARY OF THE INVENTION

An electrical cable embodying the present invention has a single yarn tensile strength member. A plurality of fine copper strands are helically wound about the single yarn tensile strength member and in contact with it. A polyvinylchloride insulated jacket is extruded over the copper strands. A polyvinylchloride foam filler layer may be extruded over a plurality of such insulated cables, and a non-porous polyvinylchloride jacket extruded over the foam filler layer.

It is a principal aspect of the present invention to provide a high strength electric cord or cable for household use.

It is another aspect of the present invention to provide an electrical cable from which the insulation easily may be stripped by automated equipment without damaging the conductors thereof.

It is yet another aspect of the present invention to provide an electrical cable with multiple leads inside an outer jacket of maximal flexibility and minimal weight which easily may be stripped by automated equipment.

Other aspects of the present invention will become obvious to one skilled in the art upon a perusal of the specification and the claims in light in the accompanying drawings.

DETAILED DESCRIPTION OF THE PREFERRED EMBODIMENTS

Figure 1:
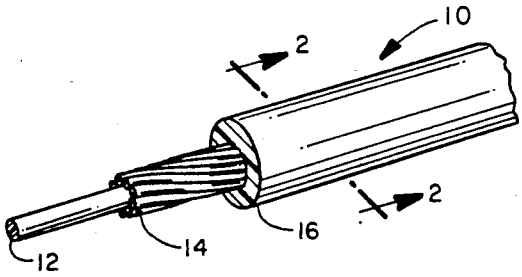
FIG. 1 is an isometric view of an electrical cable embodying the present invention.
Figure 2:
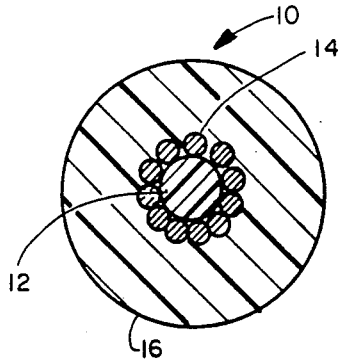
FIG. 2 is a section taken substantially along line 2—2 of FIG. 1 showing details of the internal arrangement of the electrical cable.

Referring now to the drawings and especially to FIGS. 1 and 2, an electrical cable or flexible cord embodying the present invention and generally identified by numeral 10 is shown therein. The electrical cable 10 includes a single yarn, centrally located, circular cross section tensile strength member 12. The strength member 12 is comprised of a multi-filament 1500 denier polyamide yarn, coated with polyurethane, having a high modulus and of the type sold under the designation Kevlar 29 or alternatively, Kevlar 49. The yarn has a diameter of 0.010–0.015 inches. A coating of polyurethane covers the polyamide yarn in order to prevent it from fraying. Alternatively, nylon, varnish or epoxy coating could be used to prevent fraying of the polyamide yarn. It should be appreciated that the polyurethane fray resisting coating also meets Underwriters Laboratories 90° C. temperature standards. A plurality of copper strands 14 is wound helically about the single yarn strength member 12. The plurality of copper strands 14 comprises between 41 and 65 strands in the present embodiment. Each of the strands 14 has a circular cross section. It may be appreciated that the strands 14 are wound about the single yarn strength member 12 without any intermediate filler or layered material such as paper, jute, and the like being interposed in between. The plurality of strands 14 contacts and substantially completely covers the single yarn strength member 12. Each of the strands 14 has a diameter in the range of 0.0050 inches or greater. In some embodiments of the present invention each of the copper strands may have a diameter of 0.010 inches. For such a strand diameter, only sixteen copper strands would typically comprise the plurality. A polyvinylchloride insulating jacket 16, having a circular cross section, is extruded over the plurality of copper strands 14 to substantially completely cover and enclose them.

Figure 3:
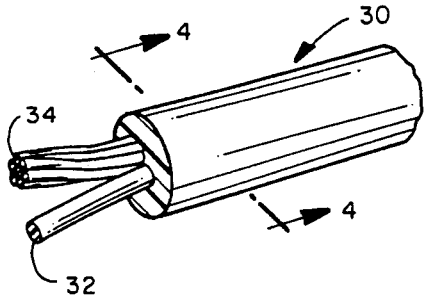
FIG. 3 is an isometric view of an alternate embodiment of the electrical cable.
Figure 4:
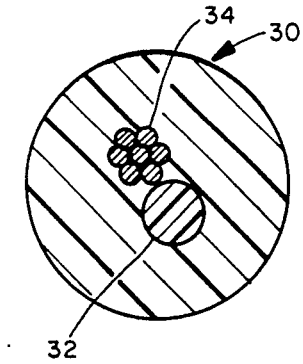
FIG. 4 is a section taken substantially along line 4—4 of FIG. 3 showing details of the internal arrangement of the electrical cable.

Referring now to FIGS. 3 and 4, an alternative electrical cable 30 is shown therein. The electrical cable 30 includes a single yarn high modulus polyamide tensile strength member 32 having a substantially circular cross section. The polyamide strength member 32 is composed of Kevlar 29 or Kevlar 49 and has a diameter of 0.010–0.015 inches. A plurality of copper conductor strands 34 is helically wound about each other and located adjacent to the strength member 32. The copper conductor strands 34 are each 0.0050 inches or greater in diameter. In the present embodiment, between 41 and 65 strands are employed. A polyvinylchloride jacket 36 is extruded over the strength member 32 and the conductor strands 34.

Figure 5:
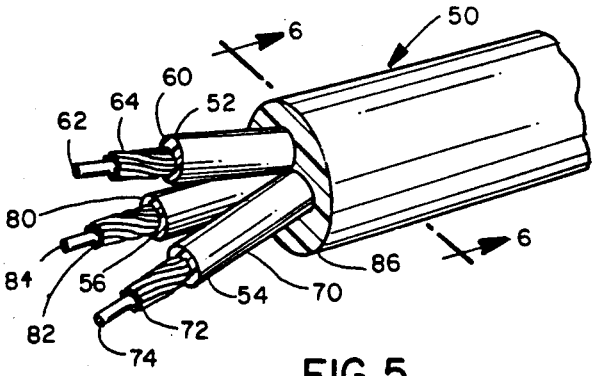
FIG. 5 is an isometric view of another alternate embodiment of the electrical cable.
Figure 6:
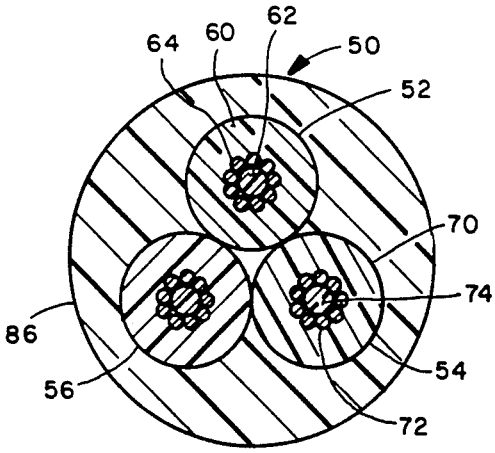
FIG. 6 is a section taken substantially along line 6—6 of FIG. 5 showing details of the internal organization of the electrical cable.
Figure 7:
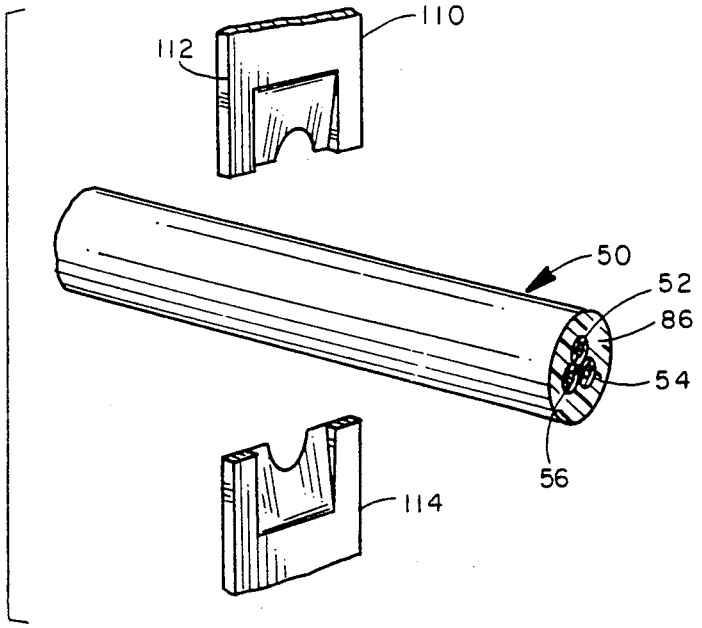
FIG. 7 is an isometric view of the cable of FIG. 6 positioned proximately with a pair of cutters, portions of which are shown.
Figure 8:
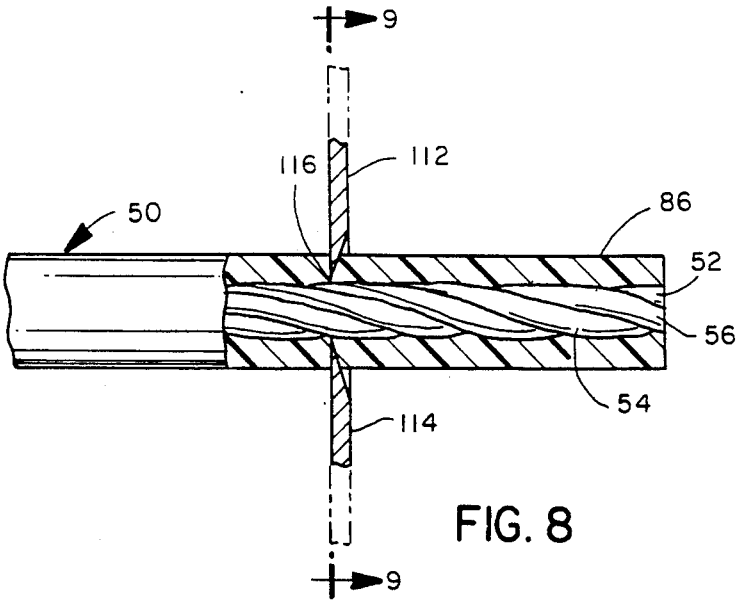
FIG. 8 is an elevational view, partially in section, of the cable of FIG. 7 with the cutters engaging it.
Figure 9:
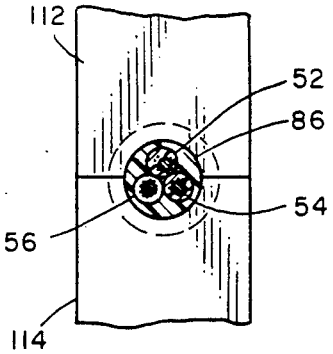
FIG. 9 is an end view of the cable and cutters of FIG. 8.
Figure 10:
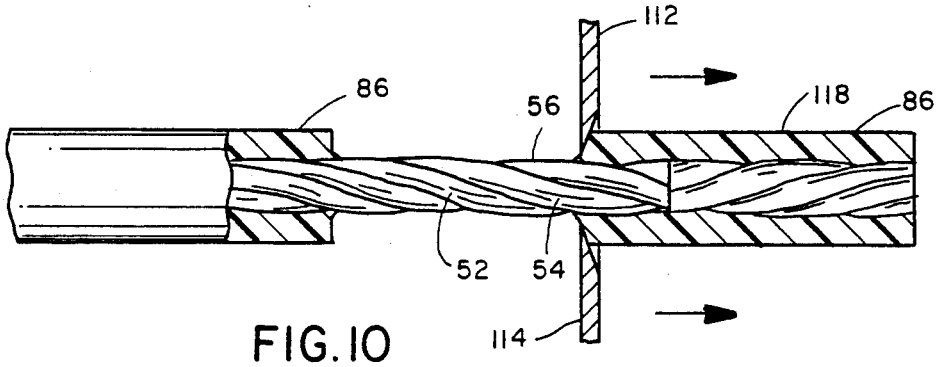
FIG. 10 is an elevational view, partially in section, of the cable of FIG. 8 showing an outer jacket being stripped off by the cutters.
Figure 11:
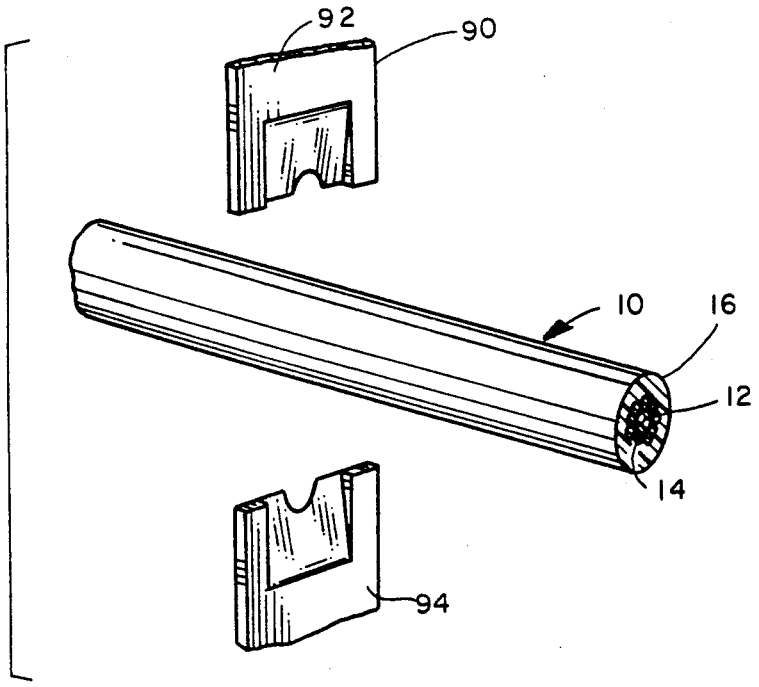
FIG. 11 is an isometric view of the cable of FIGS. 1 and 2 positioned proximately with a pair of cutters, portions of which are shown.
Figure 12:
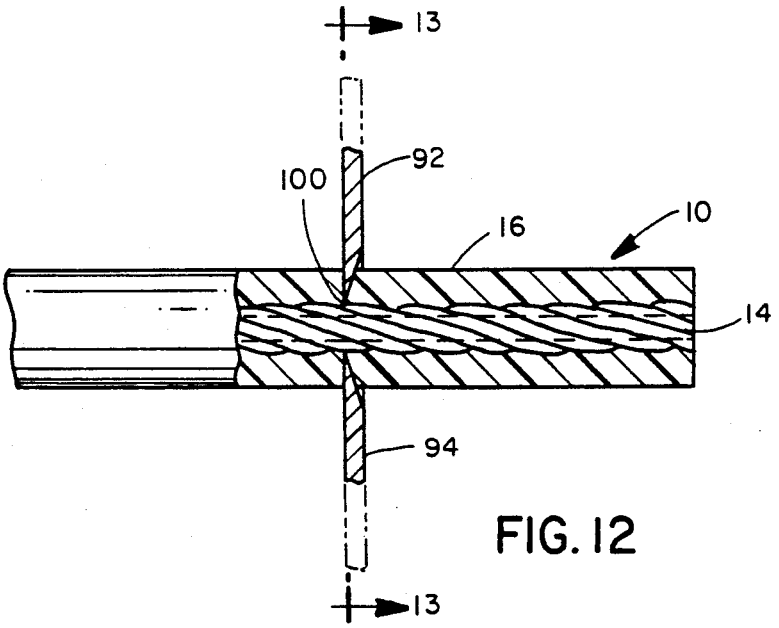
FIG. 12 is an elevational view, partially in section, of the cable of FIG. 11 with the cutters engaging it.
Figure 13:
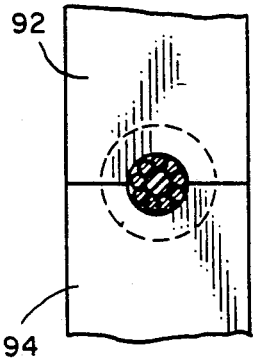
FIG. 13 is an end view of the cable and cutters of FIG. 12.
Figure 14:
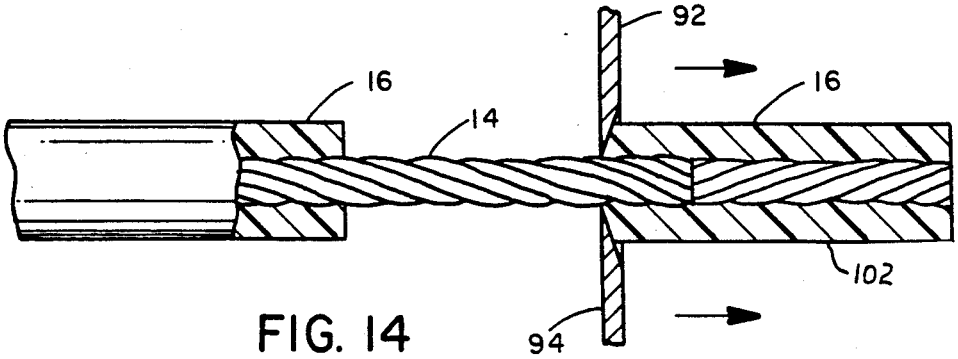
FIG. 14 is an elevational view, partially in section, of the cable of FIG. 12 showing a jacket being stripped off by the cutters.

In a still further embodiment, as may best be seen in FIGS. 5 and 6, a multiple-lead cable 50 has a plurality of high strength cords 52, 54, and 56. Each of the cords 52, 54, and 56 is substantially identical to the cable 10 shown in FIGS. 1 and 2 and described above. The cord 52 has an inner polyvinylchloride jacket 60 which is extruded over a single yarn polyamide tensile strength member 62 coated with polyurethane and a plurality of copper conductor strands 64 are disposed helically about and in contact with the strength member 62. The cord 54 has an inner polyvinylchloride jacket 70 surrounding and contacting a plurality of helically wound copper conductor strands 72. A single yarn polyamide tensile strength member 74 is coated with polyurethane and completely surrounded by and in contact with the copper conductor strands 72. The cord 56 has an inner polyvinylchloride jacket 80 having a plurality of copper conductor strands 82 helically wound inside thereof with a single yarn polyamide tensile strength member 84 coated with polyurethane and completely surrounded by and in contact with the plurality of copper conductors 82. An outer polyvinylchloride jacket 86 surrounds and contacts the inner jackets 60, 70 and 80. The outer polyvinylchloride jacket 86 is extruded over the jackets 60, 70 and 80.

Figure 15:
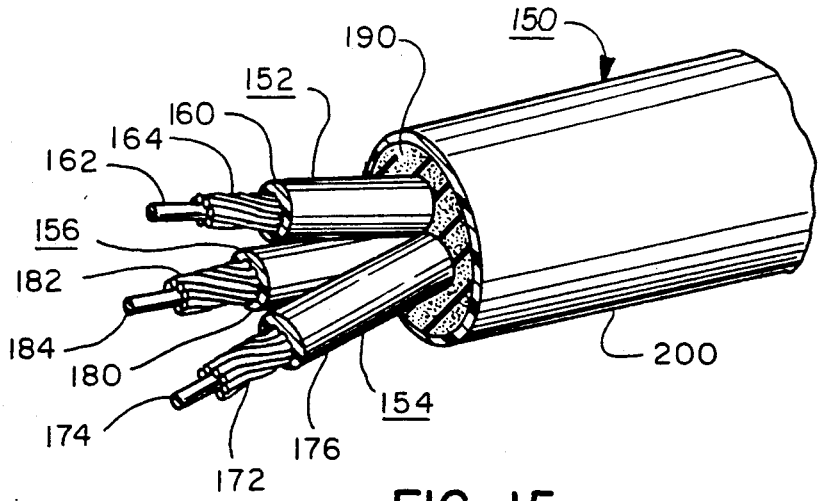
FIG. 15 is an isometric view of yet another alternate embodiment of the electrical cable.
Figure 16:
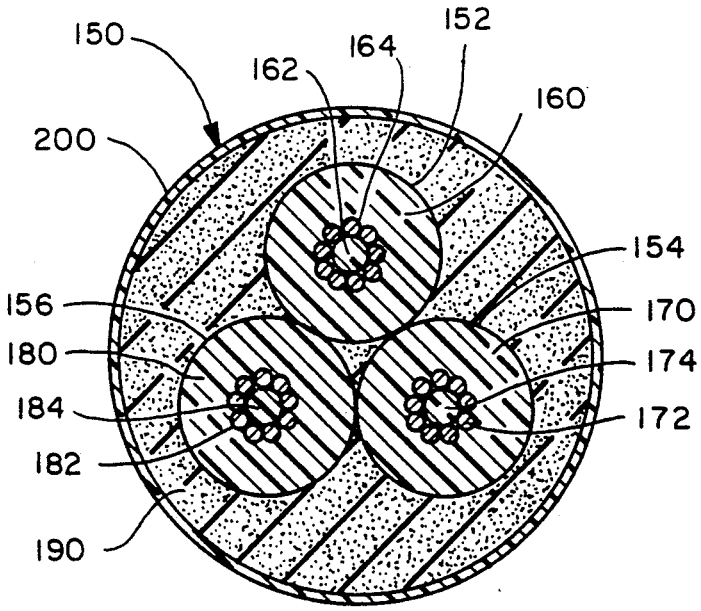
FIG. 16 is a section taken substantially along line 6—6 of FIG. 15 showing details of the internal organization of the electrical cable.
Figure 17:
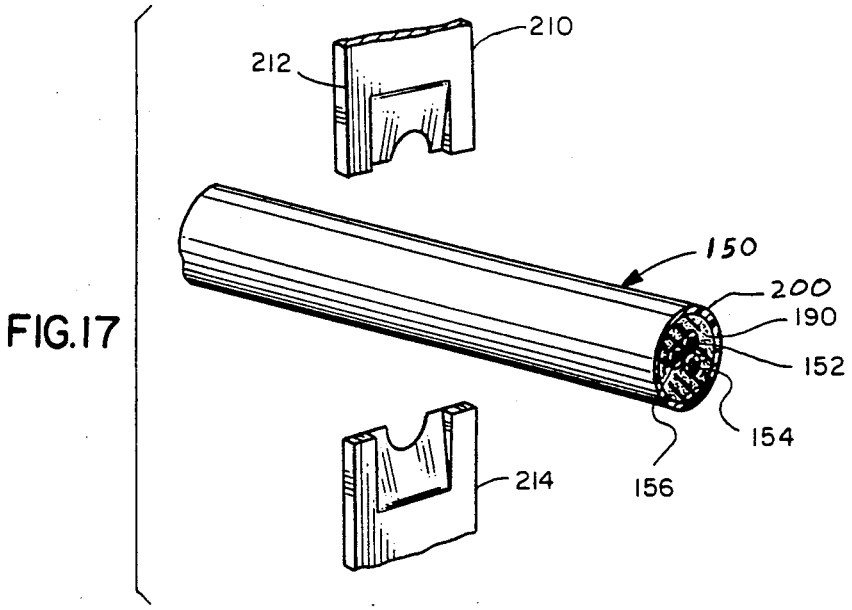
FIG. 17 is an isometric view of the cable of FIG. 16 positioned proximately with a pair of cutters, portions of which are shown.
Figure 18:
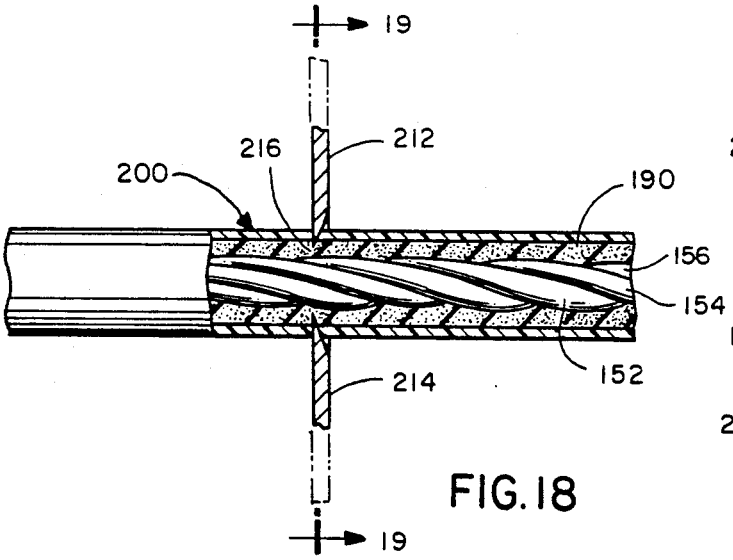
FIG. 18 is an elevational view, partially in section, of the cable of FIG. 17 with the cutters engaging it.
Figure 19:
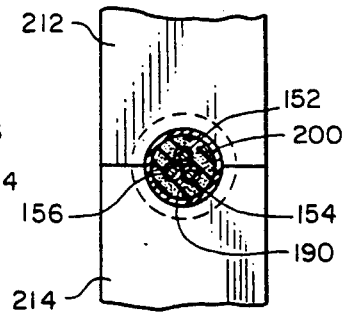
FIG. 19 is an end view of the cable and cutters of FIG. 18.
Figure 20:
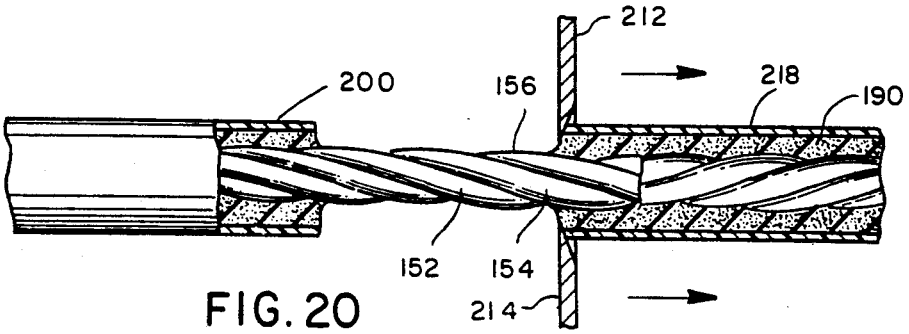
FIG. 20 is an elevational view, partially in section, of the cable of FIG. 18 showing an outer jacket being stripped off by the cutters.

In a still further embodiment, as may best be seen in FIGS. 15 and 16 a foam-skin composite jacket multiple-lead cable 150 has a plurality of high strength cords 152, 154, and 156. Each of the cords 152, 154, and 156 is substantially identical to the cable 10 shown in FIGS. 1 and 2 and described above. The cord 152 has an inner polyvinylchloride jacket 160 which is extruded over a single yarn polyamide tensile strength member 162 coated with polyurethane and a plurality of copper conductor strands 164 are disposed helically about and in contact with the strength member 162. The cord 154 has an inner polyvinylchloride jacket 170 surrounding and contacting a plurality of helically wound copper conductor strands 172. A single yarn polyamide tensile strength member 174 is coated with polyurethane and completely surrounded by and in contact with the copper conductor strands 172. The cord 156 has an inner polyvinylchloride jacket 180 having a plurality of copper conductor strands 182 helically wound inside thereof with a single yarn polyamide tensile strength member 184 coated with polyurethane and completely surrounded by and in contact with the plurality of copper conductors 182. A polyvinylchloride foam filler layer 190 surrounds and contacts the inner jackets 160, 170, and 180. The polyvinylchloride foam filler layer is formed during the extrusion process by blending 100 parts polyvinylchloride with 1 part azo-dicarbonamide type foaming agent at a temperature of about 200° C., which is sufficient to activate the foaming agent and melt the polyvinylchloride but insufficient to destroy the polymer. The foam filler layer has approximately 35% void content. An outer polyvinylchloride jacket 200 surrounds and contacts the polyvinylchloride foam filler layer 190. The outer polyvinylchloride jacket 200 is extruded over the foam filler layer 190. The polyvinylchloride foam filler layer 190 can have a thickness in the range of approximately 25–75% that of the thickness of the outer jacket 200.

It may be appreciated that the single yarn strength member provides a number of advantages to the users of the instant invention. The single yarn high modulus tensile strength member is flexible and provides high strength to the cord 10 allowing the cord to exceed the 170 pound tensile strength requirement set forth by Underwriters Laboratories and other standards-making organizations.

It may also be appreciated that the flexible cord with multiple leads surrounded by an outer jacket of foam and a non-porous skin provides a cord that is cheaper and lighter than a cord using solid polyvinylchloride and more flexible than a cord using paper or jute fillers. The foam filler layer uses less polyvinylchloride than the solid polyvinylchloride needed to fill the grooves between leads in the cord, so is therefore cheaper to produce and lighter in weight than an all-solid polyvinylchloride cord. The foam filler layer is also more flexible than the same thickness of solid polyvinylchloride or paper and jute fillers. The outer jacket of polyvinylchloride meets the non-porosity requirement for cable jackets as set forth by Underwriters Laboratories and other standards-making organizations.

Additionally, as may best be seen in FIGS. 11 through 14, the cable 10 may be quickly and easily stripped. A cutter 90 having a pair of mating cutter halves 92 and 94 may be used to strip the polyvinylchloride jacket 16 down to the copper strands 14. Since there is no intermediate layer, such as paper, jute, cotton or rayon, between the copper conductor strands 14 and the polyvinylchloride jacket 16, the jacket 16 need not be cut all the way through; a thin web portion 100 may be left. The remaining thin web portion 100 then is severed by stretching it, while the copper conductor strands 14 and the inner strength member 12 remain intact. A severed portion 102 of the jacket 16 is then removed by sliding it off the copper conductor strands 14 In addition, the tensile strength member 12, since it is located within the helically wound strands 14, is unaffected by the stripping process; so that even when stripped of the outer jacket 16 down to the conductor strands 14, the cable 10 retains its high strength.

The cable 30, shown in FIGS. 3 and 4, also may be stripped down to the strength member 32 and the copper strands 34 and the polyvinylchloride insulation 36 easily removed therefrom. Should it be desired, the tensile strength member 32 may then be separated from the conductor strands 34 to allow the conductor strands 34 to be fitted into relatively small connectors of the type used in electrical plugs to which they must be electrically connected.

The multiple-lead cable 50 also may be stripped in a similar fashion, as may best be seen in FIGS. 7 through 10. A pair of cutter halves 110 having a first cutter 112 and a second cutter 114 cut through the outer jacket 86 leaving only a thin web portion 116 intact. The outer jacket 86 is then stretched and a severed portion 118 is removed from the cords 52, 54 and 56. The individual cords 52, 54 and 56 then are stripped in the manner set forth above.

The foam-skin composite jacket multiple-lead cable 150 also may be stripped in a similar fashion, as may best be seen in FIGS. 17 through 20. A pair of cutter halves 210 having a first cutter 212 and a second cutter 214 cut through the outer jacket 200, and cut substantially into the foam filler layer 190, leaving a portion of the foam filler layer 216 intact. The outer jacket 200 and the foam filler layer 190 are then stretched, easily tearing the intact portion of the foam filler layer 216, and a severed portion 218 is removed from the cords 152, 154, and 156. The individual cords 152, 154, and 156 are then stripped in the manner set forth above.

It may be appreciated that the foam-skin composite jacket multiple-lead cable is significantly easier to strip than conventional multiple-lead cables. The foam filler layer has a lower tensile strength than the same thickness of either paper and jute or solid polyvinylchloride, therefore requiring less longitudinal force for stripping. The foam filler layer also separates from the inner leads more easily than a solid polyvinylchloride outer jacket does, because the foam void content reduces the surface area of actual physical contact between the polyvinylchloride of the foam and the inner leads, thereby reducing frictional forces.

A particular advantage of the present invention lies in the fact that a single yarn of polyamide is used in the fabrication of the instant invention, rather than multiple yarns which must be bundled before the helical copper strands are wound thereabout. The single yarn of flexible polyamide fiber avoids the necessity of holding multiple yarns in proximity with each other while the multiple copper strands are wound thereabout. Thus, it may be appreciated that the instant invention provides a high strength electrical cable which may be easily stripped in a machine operation, but which remains flexible and easy to build.

While there has been illustrated and described a particular embodiment of the present invention, it will be appreciated that numerous changes and modifications will occur to those skilled in the art, and it is attended in the appended claims to cover all those changes and modifications which fall within the true spirit and scope of the present invention.

What is claimed is:

1. An electrical cable comprising:

a plurality of insulated cords, each of said insulated cords comprised of:

a single yarn tensile strength member, a plurality of conductors helically wound about and in contact with the single yarn tensile strength member, and an inner insulating jacket surrounding the helically wound conductors and the single yarn tensile strength member;

a foam filler layer surrounding said plurality of insulated cords; and an outer insulating jacket surrounding said foam filler layer.

2. An electrical cable according to claim 1, wherein said single yarn tensile strength member of each said insulated cord comprises a polymer.

3. An electrical cable according to claim 1, wherein said single yarn tensile strength member of each said insulated cord comprises a polyamide.

4. An electrical cable according to claim 3, wherein said plurality of metal conductors comprises copper.

5. An electrical cable according to claim 4, wherein said outer and inner insulating jackets are comprised of a polymer.

6. An electrical cable according to claim 4, wherein said outer and inner insulating jackets are comprised of polyvinylchloride.

7. An electrical cable according to any of claims 1, 2, 3, 4, 5, or 6 wherein said foam filler layer is comprised of polyvinylchloride aerated during extrusion by mixing with azodicarbonamide foaming agent at about 200° C., which agent activates at that temperature to form a gas.

8. An electrical cable according to claim 7, wherein said outer insulating jacket is in contact with said foam filler layer.

9. An electrical cable according to claim 8, wherein the thickness of said foam filler layer extends approximately twice the thickness of the outer insulating jacket.

10. A method of making an electrical cable having a plurality of leads with strength members, surrounded by a foam filler layer and a non-porous outer jacket, comprising the steps of:

helically winding plurality of metallic conductors about each of a plurality of single yarn strength members;

extruding an inner jacket over each of said single yarn strength members would with metallic conductors in the winding step;

extruding a foam filler layer over said inner jackets; and extruding a non-porous jacket over said foam filler layer.

11. An electrical cable comprising:

at least one insulated cord comprised of:

a single yarn tensile strength member;

a plurality of conductors helically wound about and in contact with the single yarn tensile strength member of each said at least one insulated cord;

an inner insulating jacket surrounding the helically wound conductors and the single yarn tensile strength member of said at least one insulated cord;

a foam filler layer surrounding said at least one insulated cord; and an outer insulating jacket surrounding said foam filler layer.

12. An electrical cable according to claim 1 wherein each said single yarn tensile strength member comprises a polyamide.

13. An electrical cable according to claim 12 wherein said outer and inner insulating jackets are comprised of polyvinylchloride.

14. An electrical cable according to claim 13 wherein said foam filler layer is comprised of polyvinylchloride aerated during extrusion by mixing with azodicarbonamide foaming agent at about 200° C., which agent activates at that temperature to form a gas.

15. An electrical cable according to claim 14 wherein the thickness of said foam filler layer extends approximately twice the thickness of the outer insulating jacket.

16. A method of stripping an electrical cable having a plurality of cords, each comprising a tensile strength member helically wound with a plurality of metallic conductors and surrounded by an insulating jacket, a foam layer surrounding the plurality of cords and an outer jacket positioned around the foam layer, to prepare the electrical cable to be connected to a termination, comprising the steps of:

cutting through the entire outer jacket and the foam layer of the electrical cable and leaving a thin web portion of the foam layer uncut surrounding the insulating jacket of the plurality of cords; and placing a tensile force across the web portion of the foam layer causing the web portion to part without severing the plurality of cords lying within the jacket.

* * * * *

UNITED STATES PATENT AND TRADEMARK OFFICE

CERTIFICATE OF CORRECTION

PATENT NO. : 5,113,039

DATED : May 12, 1992

INVENTOR(S) : Guipe et al.

It is certified that error appears in the above-identified patent and that said Letters Patent is hereby corrected as shown below:

At column 5, line 43, after "14" insert --.-- (period).

In the Claims:

At column 7, line 26 (Claim 10), change "would" to --wound--.

At column 8, line 8 (Claim 12), change dependency from "1" to --11--.

Signed and Sealed this

Third Day of August, 1993

Michael K. Kirk

*Attest:*

MICHAEL K. KIRK

*Attesting Officer*

*Acting Commissioner of Patents and Trademarks*